US005688138A

United States Patent [19]

Chuang

[11] Patent Number: 5,688,138

[45] Date of Patent: Nov. 18, 1997

[54] WATER-PROOF LAMP SOCKET STRUCTURE

[75] Inventor: Te Chun Chuang, Hsinchu Hsien, Taiwan

[73] Assignee: King World Enterprise Co., Ltd., Taiwan

[21] Appl. No.: 677,363

[22] Filed: Jul. 5, 1996

[51] Int. Cl.[6] ..... H01R 13/52

[52] U.S. Cl. ..... 439/280; 439/419

[58] Field of Search ..... 439/280, 281, 439/282, 283, 273, 271, 274, 278, 417, 419, 414

[56] References Cited

U.S. PATENT DOCUMENTS

| | | | |
|---|---|---|---|
| 745,173 | 11/1903 | Fielding | 439/280 |
| 1,224,030 | 4/1917 | Smith | 439/280 |
| 3,660,800 | 5/1972 | Detch | 439/280 |
| 5,366,386 | 11/1994 | Liao | 439/419 |
| 5,511,989 | 4/1996 | Cheng et al. | 439/419 |

*Primary Examiner*—Gary F. Paumen
*Assistant Examiner*—Tho Dac Ta
*Attorney, Agent, or Firm*—Beveridge, DeGrandi, Weilacher & Young L.L.P.

[57] ABSTRACT

This water-proof lamp socket structure includes a lamp socket, a ring body, an upper cover, and a water-proof ring. The lamp socket is constituted by two semi-cylinders in relative position, with a fluted penetration hole formed at both sides of its bottom. An interior wall of the lamp socket has inner threads and its exterior has a ring body. A curved groove is formed at an upper portion to accommodate a wire. The bottom upper cover inside the groove has a sharp nickel plate which a bottom upper cover with the same curved groove is placed on top of in order to penetrate the wire by the nickel plate for conduction. The bottom of lamp socket is encased with a slight trapezoidal water-proof ring. The water-proof ring is clicked into holes at both sides of the lamp socket by two catch blocks at its top in order to fix it inside the lamp socket so that it will not easily fall off. Also, the ring has several layers of elastic washer resting tightly between the inside of lamp socket and an edge of a bulb to achieve the effect of water-proofing.

9 Claims, 5 Drawing Sheets

PRIOR ART

WATER-PROOF LAMP SOCKET STRUCTURE

FIELD OF INVENTION

This invention is a type of improved water-proof lamp socket structure which has water-proofing effect is safe, and stable.

BACKGROUND OF THE INVENTION

The structure of a lamp socket that is conventionally used is shown in FIG. 1. It mainly includes a lamp socket 10. The lamp socket is constituted by two identical semi-cylinders that fit each other which has an inner thread inside to screw the base cap 111 of bulb 11. Also, a ring body 12 is fitted at an appropriate place of its exterior. Its upper interior has an accommodating groove 13 to accommodate the electric wire. There is a sharp nickel plate at the bottom of the accommodating groove 13 which is pressed on the lamp socket 10 with an upper cover 14 to force the electric wire to penetrate through the sharp nickel plate at its bottom in order to conduct electricity (not described in details in the drawing). In order to enable the lamp socket to have water-proof function, the commonly known technique is to fit a soft water-proof ring 15 between the bottom of lamp socket 10 and base cap 111 to prevent water from infiltrating into the socket and cause leakage of electricity.

Although the customary water-proof ring 15 can prevent water from infiltrating the socket in some case, the fact that there is always some error or deformation of bulb 11 during its production. Also, the water-proof ring 15 is fitted on the upper end of base cap 111 of bulb 11 to fit with the lamp socket 10, therefore, during its assembly, there is no way of calibrating the lamp socket 10 and bulb 11 to a total vertical condition which causes the two not to fit with each other and easily fell off or has a gap, and thus cannot achieve water-proofing effectively. Also, since the water-proof ring is fitted at the top of the base cap 111 of bulb 11 and checked between the base cap 111 and lamp socket 10, if the bulb 11 was faulty or burned and had to be changed, the user often will throw away the water-proof ring 15 together with the burned bulb due to negligence or complete ignorance. When a new bulb 11 is re-inserted (ordinary bulbs do not come with a water-proof ring), there is no more water-proof function on the said lamp structure which causes that lamp structure to have electric leakage or be damaged easily. Therefore, through many years of experience in lamp socket production, improvement, and research, the Applicant had overcome the above mentioned defects and had attained its goal of a complete water-proofing, safe, and stable product. Not only has this invention improved the various drawbacks of the conventional water-proof function, but also has increased the soundness of the product.

SUMMARY OF THE INVENTION

The main object of this invention is to provide a type of improved water-proof lamp socket structure, in which there is a water-proof ring at the bottom catch of the lamp socket which exterior has multi-layers of elastic washer, and hereby, achieves multiple water-proof effect.

The second object of this invention is to expose a type of improved water-proof lamp socket structure, in which there is a catch block fitted at the appropriate place at both side of the water-proof ring exterior to fit it tightly with the penetration hole on the lamp socket, so that it can not easily fall off from the lamp socket and thus be securely stable.

Another object of this invention is to display a type of improved water-proof lamp socket structure, in which there is a curved grooved similar to an electric wire shape fitted at the proper joint of lamp socket and upper cover to secure the pressed catch wire so that it will not be easily displaced and it will strengthen the fitness of the two, hereby, achieving water-proof effect.

In order to disclose the purpose, characteristic, and effect of this invention, a detailed description of the invention is given through the following concrete examples coordinated with drawings:

BRIEF DESCRIPTION OF THE DRAWINGS AND THE COMPONENT NUMBERS (A) The Drawings FIG. 1 is the schematic drawing of the conventionally waterproof lamp socket structure.

(B) The Component Numbers

| | | | |
|---|---|---|---|
| 10 | Lamp Socket | 241 | Penetration hole |
| 11 | Bulb | 25 | Curved groove |
| 111 | Base cap | 26 | Nickel plate |
| 12 | Ring body | 27 | Inner thread |
| 13 | Accommodating groove | 28 | Spring ring body |
| 14 | Upper cover | 30 | Upper cover |
| 15 | Water-proof ring | 31 | Curved Groove |
| 20 | Socket | 40 | Water-proof ring |
| 21 | Semi-cylinder | 41 | Elastic washer |
| 22 | Dowel | 42 | Projection |
| 23 | Notch | 43 | Catch |
| 24 | Flute | | |

DETAILED DESCRIPTION OF THE INVENTION

Figure 1:
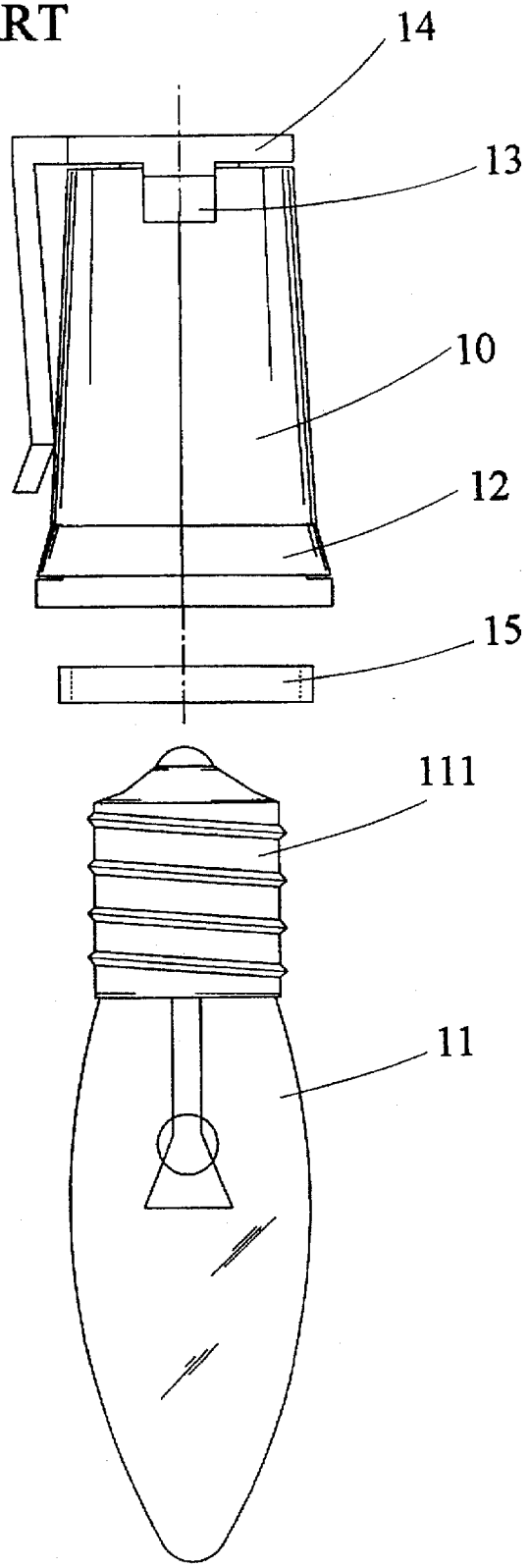
Figure 2:
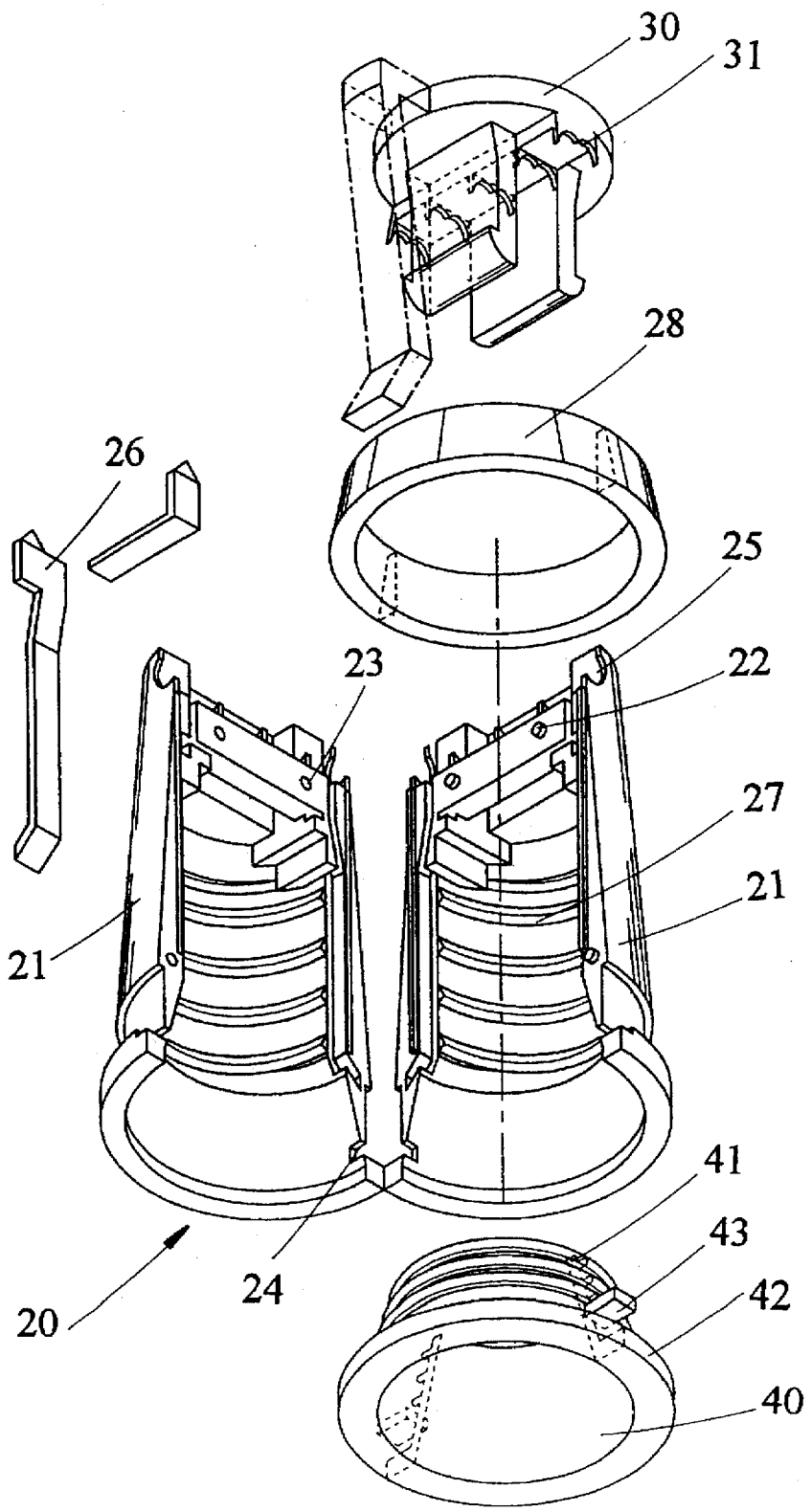
FIG. 2 is the disassembly drawing of the water-proof lamp socket structure of this invention.
Figure 3:
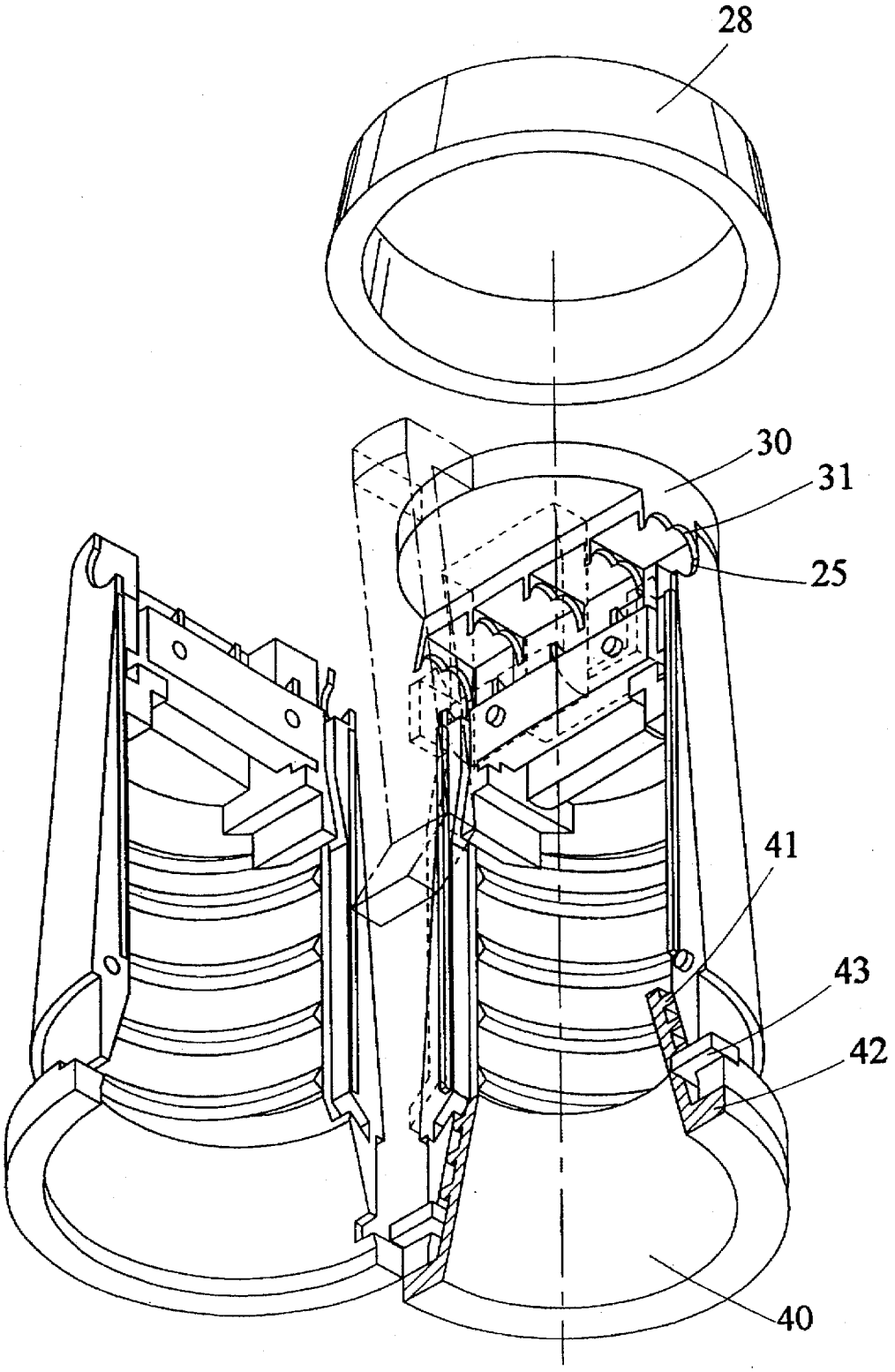
FIG. 3 is an assembly drawing showing a part of the structure of FIG. 2.
Figures 4A, 4B, 4C:
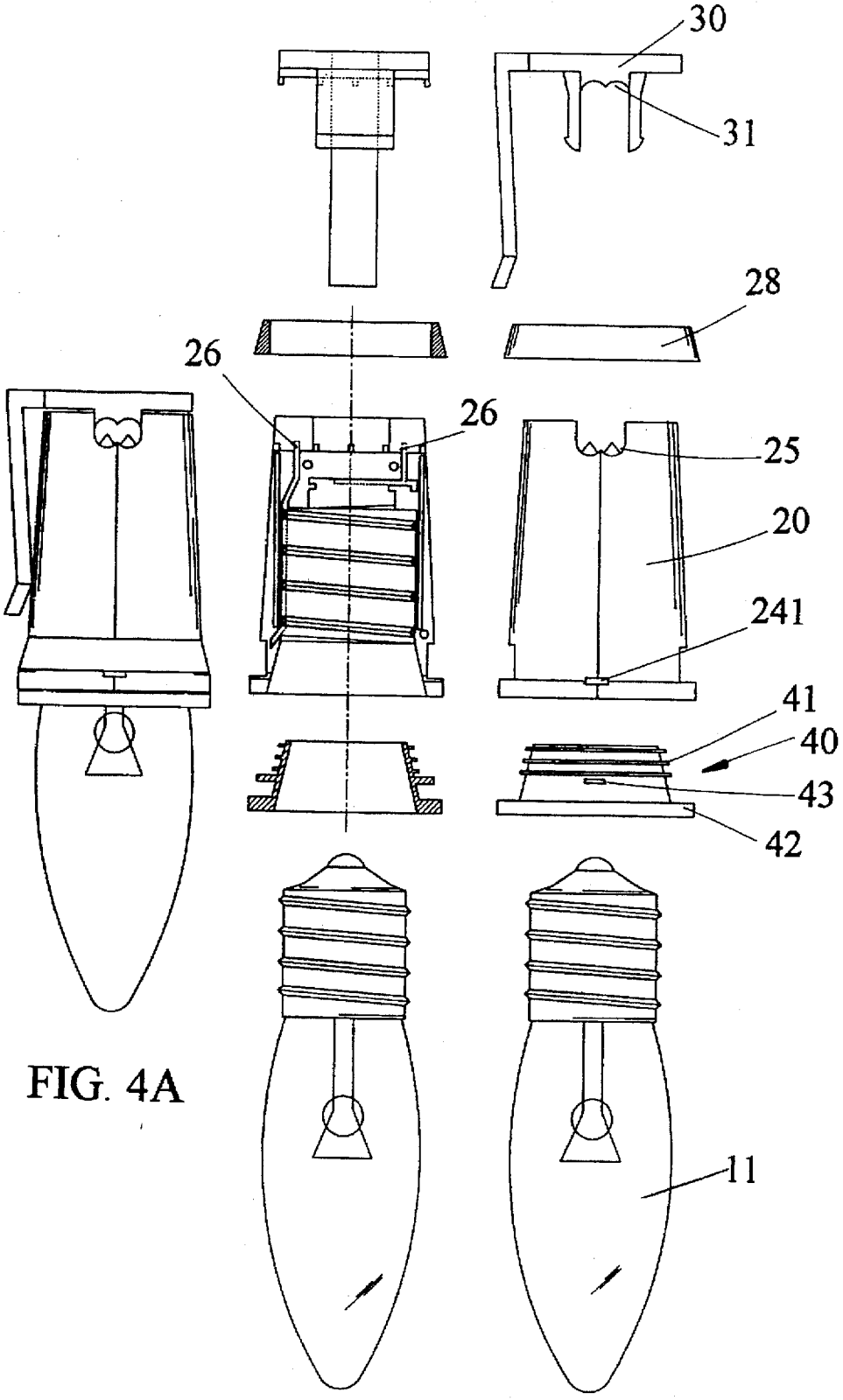
FIGS. 4A–4C are a schematic disassembly drawing of each profile of the lamp socket structure of this invention.

FIG. 2 is the exploded drawing of the water-proof lamp socket structure of this invention, which includes a lamp socket 20, upper cover 30, and a water-proof ring 40. In which, the lamp socket 20 is constituted by two semi-cylinders 21. At the lower side of one of the two semi-cylinders 21 is inter-joint. Also, there are many matching dowels 22 and notches 23 fitted on the relative joint of the two semi-cylinders, so that the two semicylinders 21 will fit each other. There are flutes 24 fitted in relative position at both sides near the bottom of the two semicylinders. When the two semi-cylinders 21 fit each other, the flutes 24 will separately assemble into a penetrating hole 241 (as shown in FIGS. 4A–4C). There is an inner thread 27 at the middle section inside the lamp socket 20 formed by two semi-cylinders 21 to fit with the base cap 111 of bulb 11. There is a curved groove 25 fitted horizontally at the proper place at the upper part of inner thread 27, and there is a sharp nickel plate 26 fitted at the bottom of the said curved groove 25. The sharp end of nickel plate 26 exactly projected to the bottom of the said curved groove 25. That curved groove 25 forms into an accommodating space to facilitate the wire to pass through. There is an upper cover 30 fitted into its upper press catch (as shown in FIG. 3) to force the wire accommodated on the curved groove 25, so that the wire will be penetrated by the sharp nickel plate at its bottom and start to conduct electricity. There is a water-proof ring 40 fitted inside the bottom of lamp socket 20. There are several elastic washer 41 fitted on the exterior of the said water-proof ring 40, and its bottom has a projection 42. There are catch blocks 43 separately fitted between the two sides of elastic washer 41 and projection 42. When the water-proof ring is fitted into the bottom of lamp socket 20, the catch blocks at both sides will fit exactly into the flute 24 and form a penetrating hole. Then a spring ring body 28 is fitted at the proper place of the lamp socket exterior so that the said water-proof ring 40 will be fixed securely inside the lamp socket 20.

Figure 5A:
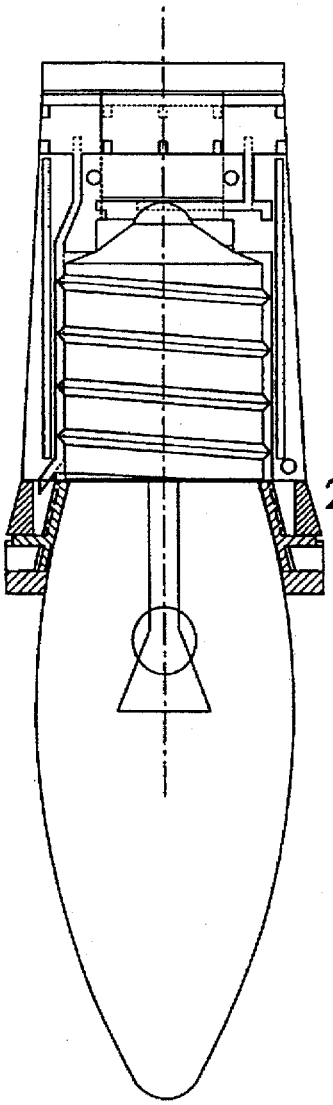
FIGS. 5A–5B are the schematic assembly drawing of this invention.
Figure 5B:
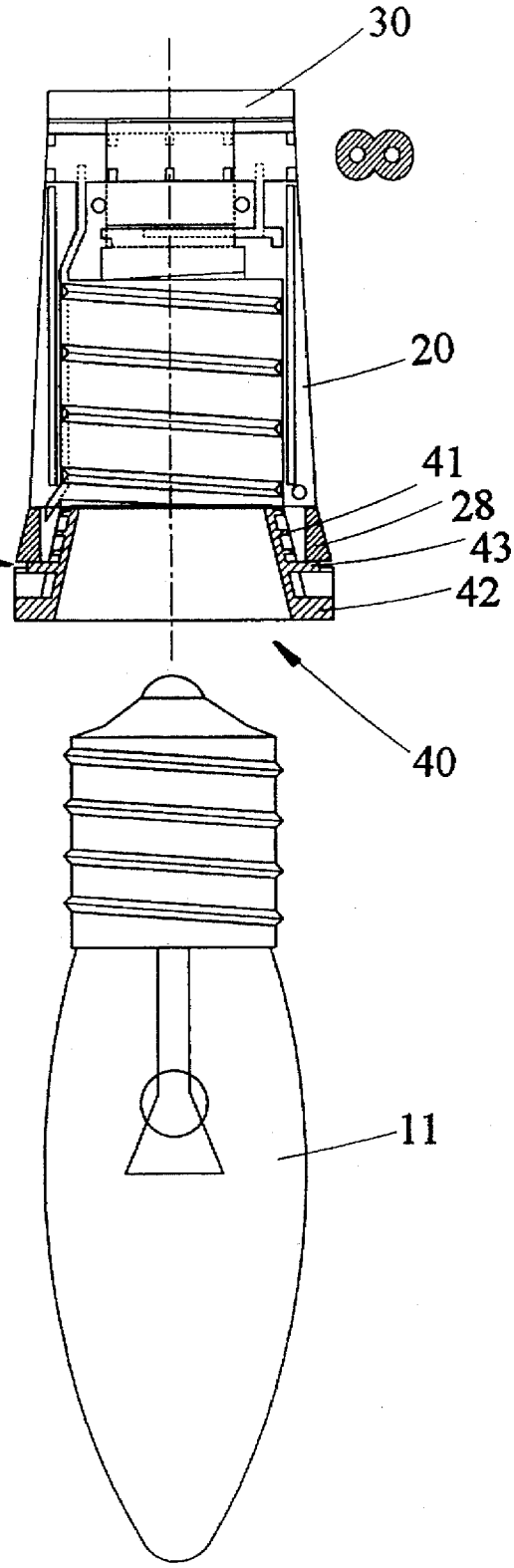

FIG. 4A to 4C are schematic exploded drawing of each profile of the lamp socket structure of this invention. In which, there is a curved groove 25 fitted horizontally at the upper part of lamp socket 20 and assemble relatively with the curved groove 31 at the bottom of upper cover 30. The shape of the space formed by curve grooves 25 and 31 is similar to the shape of the electric wire, so that the exterior of electric wire will fit completely within the interior of the two curved grooves 25 and 31 which will press the wire so that it will not be easily displaced. It also strengthens the fitness between the wire and the curved grooves 25 and 31 to be water proof. Also, comparing again with FIGS. 5A and 5B which are the schematic assembly drawing of this invention, there is a water-proof ring 40 fitted into the inside bottom of lamp socket 20. The said water-proof ring 40 is a flexible trapezoidal ring body which has catch blocks 43 fitted separately at both side of its exterior to click it into the bottom of lamp socket 20 and penetrate into the penetration hole 241 formed by flute 24, so that it will fix securely inside the lamp socket 20 and not easily fall out. There are several elastic washer 41 fitted at the proper place of the upper exterior part of water-proof ring 40. When the two catch blocks 43 clicked into the penetrating hole 241, those elastic washers 41 will contact and jam the inside the wall of lamp socket 20 and projection 42 at its bottom will adhere at the bottom of lamp socket 20. When the bulb 11 is screwed into the lamp socket 20, it will press inside the water-proof ring 40 so that its exterior will be fitted inside the wall of lamp socket 20. By fitting it with multi-layer elastic washers 41 and projection 42, the socket 20 will have multiple water-proof features. Simultaneously, it can prevent the bulb 11 from getting skewed due to error in production process, thus will enable the bulb 11 to be fitted securely inside the lamp socket 20.

Since the water-proof ring 40 is fixed on the lamp socket 20 by the catch blocks 43 at both side, it will not fall off when changing the bulb 11, hence, it is secure. Also, multiple water-proof effect is achieved through the multi-layer elastic washer on the water-proof ring, ensuring no water can infiltrate the inner bottom of lamp socket 20, which effectively addresses the various drawbacks in the customary lamp socket.

Summing up the above, it is now known that the improved water-proof lamp socket structure of this invention really has its practicality and inventiveness. Also, this invention hasn't been seen in any publication yet, which conforms with the patent requirement stipulated in the Patent Law.

The above mentioned description is only one of the better examples of this invention, which should not be used as a limitation to the implementation scope of this invention. All the variation and finishing made on the patent scope applied by this invention shall all be considered as within the scope covered by this invention patent.

What is claimed is:

1. A water-proof lamp socket structure, comprising:

a lamp socket defined by two interconnected semi-cylinders, the lamp socket having a sharp nickel plate disposed therein and an inner thread defined at a middle interior section for threadably receiving a bulb base cap;

a ring body engaging an exterior surface of the lamp socket;

an upper cover engaged with an upper end of the lamp socket for forcing a wire to be penetrated by the sharp nickel plate to conduct electricity, curved grooves being respectively defined in relative positions at the upper end of the lamp socket and at a bottom end of the upper cover such that when the upper cover is enqaged with the lamp socket, the wire is contained within openings defined by the curved grooves, and a flexible trapezoidal water-proof ring engaging a bottom of the lamp socket, an upper exterior of the water-proof ring having a plurality of elastic washers and a projection.

2. The water-proof lamp socket structure as claimed in claim 1, wherein the plurality of elastic washers on the water-proof ring are biased against an inner wall of the lamp socket when the water-proof ring is engaged with a bulb.

3. The water-proof lamp socket structure as claimed in claim 1, wherein two flutes are respectively defined in opposition on each side of a bottom of the two semi-cylinders.

4. The water-proof lamp socket structure as claimed in claim 3, wherein the flutes define opposing holes in the lamp socket.

5. The water-proof lamp socket structure as claimed in claim 4, wherein the water-proof ring further includes catch blocks extending from at least two opposed sides of the water-proof ring, the catch blocks being respectively received in the holes defined by the flutes.

6. The water-proof lamp socket structure as claimed in claim 3, wherein the flutes define opposing holes in the lamp socket.

7. The water-proof lamp socket structure as claimed in claim 6, wherein the water-proof ring further includes catch blocks extending from at least two opposed sides of the water-proof ring, the catch blocks being respectively received in the holes defined by the flutes.

8. The water-proof lamp socket structure as claimed in claim 6, wherein the projection of the water-proof ring extends outwardly from the water-proof ring.

9. The water-proof lamp socket structure as claimed in claim 4, wherein the waterproof ring further includes catch blocks extending from at least two opposed sides of the water-proof ring, the catch blocks being respectively received in the holes defined by the flutes.

* * * * *